US010156038B2

(12) United States Patent
Bohm et al.

(10) Patent No.: US 10,156,038 B2
(45) Date of Patent: Dec. 18, 2018

(54) HOUSEHOLD APPLIANCE HAVING AN EMBOSSED WALL

(75) Inventors: Andreas Bohm, Berlin (DE); Klaus Försterling, Amerang (DE); Kemal Genc, Berlin (DE); Johannes Geyer, Haar (DE); Stefan Schmidt, Kleinmachnow (DE)

(73) Assignee: BSH Hausgeräte GmbH, Munich (DE)

( * ) Notice: Subject to any disclaimer, the term of this patent is extended or adjusted under 35 U.S.C. 154(b) by 452 days.

(21) Appl. No.: 13/131,044

(22) PCT Filed: Dec. 7, 2009

(86) PCT No.: PCT/EP2009/066467

§ 371 (c)(1),
(2), (4) Date: May 25, 2011

(87) PCT Pub. No.: WO2010/066653

PCT Pub. Date: Jun. 17, 2010

(65) Prior Publication Data

US 2011/0227462 A1 Sep. 22, 2011

(30) Foreign Application Priority Data

Dec. 12, 2008 (DE) ..... 10 2008 054 574
Jul. 10, 2009 (DE) ..... 10 2009 027 614

(51) Int. Cl.
*A47B 77/06* (2006.01)
*D06F 39/12* (2006.01)
*A47L 15/42* (2006.01)

(52) U.S. Cl.
CPC ..... *D06F 39/12* (2013.01); *A47L 15/4209* (2016.11)

(58) Field of Classification Search
USPC ..... 312/228, 257.1, 265.5, 265.6; 68/23.1; 8/159; D32/6–13
See application file for complete search history.

(56) References Cited

U.S. PATENT DOCUMENTS

D114,436 S * 4/1939 Breckenridge ..... D32/7
D456,572 S * 4/2002 Resuello et al. ..... D32/6
(Continued)

FOREIGN PATENT DOCUMENTS

DE 8226335 U1 2/1983
EP 1602772 A1 12/2005
GB 2288505 A 10/1995

OTHER PUBLICATIONS

International Search Report PCT/EP2009/066467, dated Jun. 5, 2010.

*Primary Examiner* — Matthew W Ing
(74) *Attorney, Agent, or Firm* — Nixon & Vanderhye P.C.

(57) ABSTRACT

A household appliance includes a cabinet-shaped housing comprised of a plurality of walls. At least one of the walls has an arrangement of embossings. The arrangement of embossings includes a first embossing arranged centered in relation to a center of the at least one wall and configured in the shape of a ring when viewed from above. A second embossing is arranged outside the first embossing in substantial concentric relationship to the first embossing and configured in the shape of a ring when viewed from above. At least one third embossing is arranged outside the second embossing and has a strip-shaped configuration. The presence of embossings in the at least one wall is able to reduce vibrations and thereby significantly reduce the amount of unwanted noise.

31 Claims, 6 Drawing Sheets

(56) References Cited

U.S. PATENT DOCUMENTS

| | | | | |
|---|---|---|---|---|
| 6,387,468 | B1 * | 5/2002 | Kim et al. | 428/67 |
| D465,308 | S * | 11/2002 | Resuello et al. | D32/6 |
| 6,564,908 | B2 * | 5/2003 | Sanchez | B66B 11/0226 187/401 |
| D575,463 | S * | 8/2008 | Mao et al. | D32/6 |
| D638,592 | S * | 5/2011 | Suh | D32/8 |
| D642,753 | S * | 8/2011 | Ha | D32/6 |
| 8,083,299 | B2 * | 12/2011 | Funcken et al. | 312/228 |
| 2004/0206134 | A1 * | 10/2004 | Kim et al. | 68/23.1 |
| 2005/0257326 | A1 * | 11/2005 | Schneider et al. | 8/159 |
| 2011/0298338 | A1 * | 12/2011 | Kim et al. | 312/109 |

* cited by examiner

HOUSEHOLD APPLIANCE HAVING AN EMBOSSED WALL

BACKGROUND OF THE INVENTION

The invention relates to a household appliance having a cabinet-shaped housing, comprising a plurality of walls, at least one of which has an arrangement of embossings. In particular the invention relates to a household device in the form of a laundry care device such as a washing machine, tumble dryer or a washer/dryer and also to a household appliance in the form of a refrigerator, a dishwasher, a chest freezer, a hob and the like.

For a cabinet-shaped household appliance which is equipped with at least one drive motor, especially for a washing machine, vibrations often occur during the operating cycle in the walls basically formed from sheet metal or plastic panels. These have a series of disadvantages since they lead to an increased development of especially undesired noises and also impose a strain on the housing of the household appliance. Measures have thus been introduced to counter such vibrations, in particular the side walls of washing machines have been provided with reinforcements. Despite such reinforcements however the vibrations of flat surfaces of the walls still remain too high.

Thus in accordance with DE 82 26 335 U1 the side walls of a household appliance are provided with especially three vertically orientated embossings distributed equally over the entire surface of each side wall. The embossings are embodied as dished areas and are curved outwards in relation to an interior space of the household appliance. What was not considered however was that formation of a plurality of congruent surface sections causes each individual surface section to act as a membrane capable of vibration with its own resonant frequency. A number of identical surface sections with the same resonant frequency lead to an amplification of the noises generated by the vibration exciter at precisely this frequency.

To avoid these disadvantages, in accordance with DE 94 05 986 U1, at least three embossings of the same width narrow by comparison with their length are arranged distributed on a side wall of a household appliance at different distances from one another. This does actually reduce the disadvantages of the vibrations a little and prevents too much noise being generated.

BRIEF SUMMARY OF THE INVENTION

The underlying object of the invention is thus to overcome the disadvantages of the prior art and to provide a cabinet-shaped household appliance with an improved housing.

The object is inventively achieved by a household appliance in accordance with the independent claim. Preferred embodiments of the inventive household appliance are outlined in the dependent claims. It lies within the framework of the invention to combine a number of preferred embodiments with one another, and to do so even if no explicit reference to this is made herein.

In the inventive household appliance with a cabinet-shaped housing comprising a plurality of walls, of which at least one has an arrangement of embossings, the arrangement of embossings comprises a first embossing arranged centered in relation to a center of the wall in the shape of a ring when viewed from above, a second embossing arranged outside the first embossing and substantially concentric to the latter, in the shape of a ring when viewed from above and at least one strip-type third embossing arranged outside the second embossing.

This embodiment and arrangement of embossings is entirely novel for a household appliance and has the surprising effect, especially for a washing machine and other household appliances equipped with rotating components, of enabling vibrations and noise to be reduced to a minimum, since they are not significantly communicated to the correspondingly equipped wall and are not amplified by vibrations of this wall. As mentioned at the start, the inventive household appliance is preferably a washing machine, a washer-dryer (i.e. a combination of washing machine and dryer in one device) or a tumble dryer. The inventively embossed wall is however suitable for any other type of cabinet-shaped household appliance, e.g. for a refrigerator, dishwasher, a chest freezer, a hob, an extractor hood and the like.

The side wall is especially manufactured from a plastic-coated steel plate with a thickness of between 0.5 mm and 1.5 mm, especially of 0.88 mm, as is conventionally used for manufacturing a housing of a household appliance such as a washing machine. The reader is referred to the relevant standard DIN EN 10142 DX35D+Z in respect of the selection of the material.

Preferably side walls of the housing, i.e. walls which a user only sees when not looking at the device at right angles to a front side which bears control and display elements and the like, are provided with the said embossings. It is however also possible to provide an upper or lower side or also a door with such an arrangement of embossings. The inventive embossings are namely not only functional but also aesthetically effective and thus impart to the household appliance equipped with them a particular elegance and distinction.

However if the household appliance involved is an appliance in which the avoidance of vibrations has a large part to play, such as a washing machine, a tumble dryer or a washer/dryer, it is preferred that the side walls, which are generally rectangular, are provided with such embossings.

The first embossing is in the shape of a ring when viewed from above and is preferably formed from two ovals. In the simplest case these can be two circles, but it is preferred however for the first embodiment to not be precisely circular but to be formed from two ovals, e.g. two ellipses. In a preferred form of embodiment the two ovals which form the first embossing are similar in a mathematical sense, i.e. they are of different size but would be congruent were they of the same size. This produces a ring with a constant width. Especially preferably the first embossing is symmetrical, preferably rotation symmetrical. It can however also be point symmetrical or, in another form of embodiment, also axis-symmetrical, in this case especially preferably axis-symmetrical in two directions at right angles to one another.

The first embossing, when viewed from above, forms a ring, and a surface of the wall not covered by this embossing is thus located within this ring. Preferably this surface is free from any further embossing. This thus unembossed surface is especially of significance for a laundry care device, since the latter houses within its interior an oscillatingly supported rotating drum which requires a certain play. In this case the unembossed surface thus preferably has a minimum size, with the diameter amounting to at least a sixth of the width of the side wall, preferably at least a fifth, even more preferably a quarter and most preferably a third. The unembossed surface can however also be even larger and occupy up to half the width of the side wall. This relates to a rectangular side wall standing on end, whereby the width relates to the narrower side of the rectangle. The unembossed surface in the center of the first embossing is preferably located precisely in the middle of the rectangle, but can also be slightly offset however, in this case preferably either upwards or downwards, once again related to a rectangular side wall of the household appliance standing vertically.

The second embossing, viewed from above, has a similar shape to the first embossing, is likewise in the shape of a ring and is arranged around the outside of the first embossing so that a further ring, preferably comprising an unembossed surface, remains between the first embossing and the second embossing. The second embossing, viewed from above, is preferably delimited by two concentric ovals which are preferably not similar, so that a ring-shaped element with varying width is produced.

For example the contour of the inner oval of the second embossing in the form of the outer ring can follow that of the first embossing (i.e. be similar to this in the mathematical sense). The outer oval of the ring-shaped second embossing can for example be more strongly elliptical, by which a ring with a varying width is produced. In an especially preferred form of embodiment this outer oval of the second embossing is a horizontal ellipse (or oval), the horizontal diameter of which is greater than its vertical diameter. If the size of the second oval is selected large enough for the embossing to extend beyond the edge of the side surface, this is preferably prevented by the ellipse being truncated at the sides, so to speak flattened out. This produces a ring which in the direction of the four corners of the rectangular side wall has thicker sections. Such a shape is especially advantageous for a household appliance subjected to strong vibrations, such as a washing machine shaking with rapid rotations.

Preferably one first and one second embossing are present in each case; however a number of first or second embossings can be present, in which case the respective width of the embossing can be adapted accordingly.

Furthermore a third embossing is present. When viewed from above this is in the shape of the strip, preferably depending on the requirements of the individual case straight or curved, further preferably in the shape of a ring segment. In the forms of embodiment preferred here the third embossing has the shape of a circle, especially with rounded off corners. When viewed from above it is thus preferably formed from two curves, the ends of which are connected to each other so that a curve-shaped element is produced. The two curves can be two parallel arcs. In a preferred form of embodiment the third embossing, viewed from above, is formed from a segment of two intersecting, preferably non-similar ovals, so that a curve-shaped element is produced which is wider in the middle than at the ends. This form can also be referred to as "banana shaped".

Preferably there are two of the third embossings present in each case, however there can also be more present, whereby it is preferred that these curve-shaped third embossings are arranged so that the available surface of the as a rule rectangular wall is utilized as fully as possible. The third embossings are preferably arranged symmetrically to the center of the wall.

Such a symmetrical arrangement of the embossings is preferred overall. With a cabinet-shaped household appliance having a rectangular side wall standing on its end, it is thus preferred that a respective first and second embossing as well as two third embossings be provided, whereby the two third embossings are arranged at the top and bottom in each case and follow the round contour of the first and second embossings.

For a household appliance with a housing proportioned differently, which features a square wall for example, a total of four third embossings can be arranged in the direction of the corners. This form is also advantageous in countering vibrations.

Overall the embossings should occupy around 40% of the total surface of the wall. This is especially advantageous in the especially preferred forms of embodiment described in the examples. In another arrangement and number of embossings the ratio can also be slightly different, for example embossed to unembossed in the range of 30:70, 35:65, 40:60, 45:55, 50:50, 55:45, 60:40 and up to 65:35.

Preferably the embossings in accordance with the present invention however also have a further special feature. Preferably they are additionally curved. In household appliances the embossings are advantageously directed inwards, but in exceptional cases they can also be directed outwards.

The corresponding curvatures surprisingly have also proved to be especially stabilizing. Preferably the embossings are approximately three to four times as deep as the thickness of the side wall. However deeper embossings can also be provided, which are five to six times as deep as the thickness of the side wall. Flatter curvatures, which are only one and a half times to twice as deep as the thickness of the side wall, are also possible. For curved embossings these figures relate in each case to the deepest point of the curvature.

In a further advantageous inventive form of embodiment the curves are each provided with a bevel which is at a steeper angle to the unembossed surface than the curvature itself. This makes the manufacturing process easier and leads to an additional stability. The bevel is also present with non-curved embossings and its depth then corresponds to the embossing depth. For the preferred curved embossings, instead of a flat tool a curved tool is used as the stamp. Preferably the bend points of the bevel are then provided with radii. This makes it easier for the material to flow during the embossing process and prevents sharp edges arising. The curvature preferably has a large radius, i.e. is only slightly curved. The bevel means that even with a slight curvature a certain embossing depth is produced.

BRIEF DESCRIPTION OF THE DRAWINGS

The invention is explained in detail below with reference to the exemplary embodiments shown in the drawing. The figures show.

DETAILED DESCRIPTION OF EXEMPLARY EMBODIMENTS OF THE PRESENT INVENTION

Figure 1:
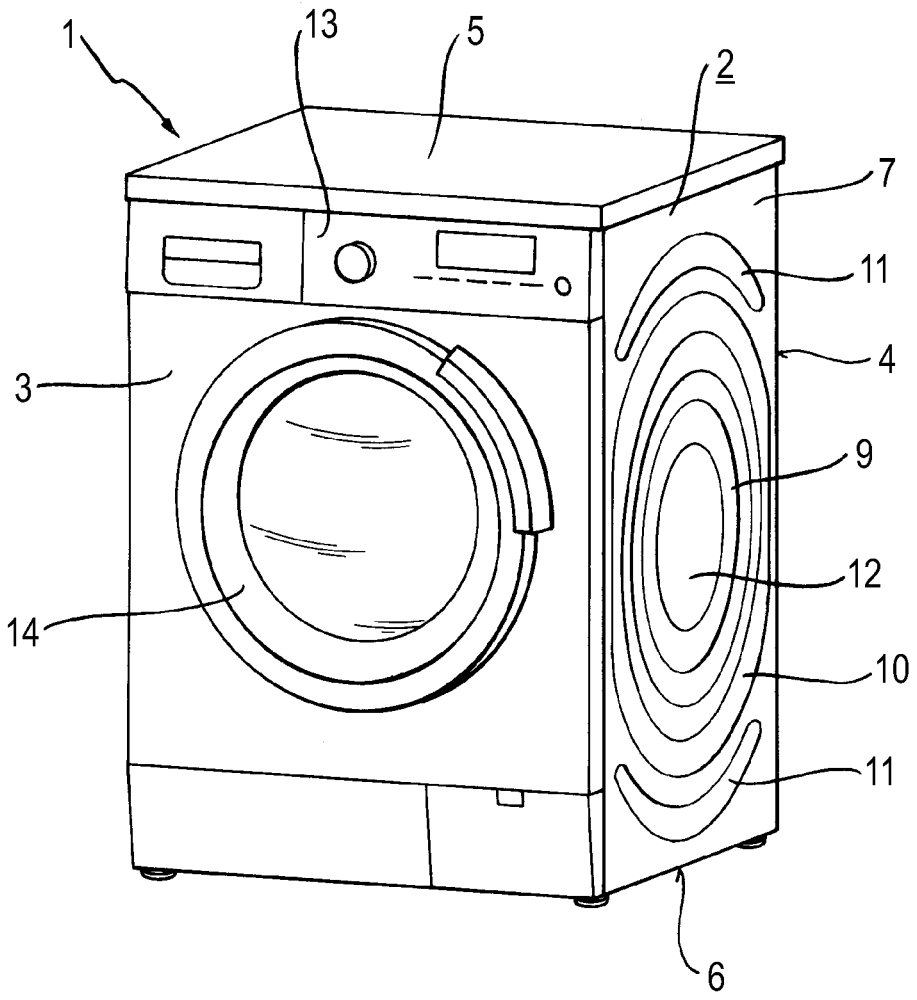
FIG. 1 a perspective view of a household appliance.

FIG. 1 shows in a slightly stylized perspective view a washing machine 1 with a housing 2, with the housing having walls 3, 4, 5, 6, 7, 8, comprising a front wall 3, a rear wall 4 not shown in the diagram, an upper side 5, a lower side 6 not shown in the diagram as well as two side walls 7 and 8 (one side wall is not shown). The washing machine 1 has a control panel 13 and a door 14 on its front side and the front wall 3 on this side. The perspectively shown side wall 7 reveals the embossings 9, 10 and 11 to be described in detail below.

In the vicinity of the center of the rectangular side wall 7 can be seen a first embossing 9 curved inwards, almost in the shape of a ring when viewed from above. The first embossing 9 is formed from two concentric and mathematically similar ellipses, so that a ring of constant width is produced. The ellipses are almost circular in shape.

In the center of the first embossing 9 there is an unembossed surface 12. This has a diameter of around a third of the width of the side wall 7, whereby the width refers to the narrower side of the rectangle standing on end. A second embossing 10 is located around the ring-shaped first embossing 9. The second embossing 10 is formed by a ring concentric to the first embossing 9, the inner oval of which is an oval similar to the first embossing 9. The outer limit of the second embossing 10 is a "horizontal" oval of which the "pointed" ends (or rounded off ends) are flattened out however, so that the oval does not extend beyond the edge of the side wall 7. This produces a ring which at its outer horizontal limit is slightly flattened out by a straight section. In this second embossing 10 thickenings are thus produced in the direction of the four corners of the side wall 7, which are especially advantageous in preventing bending vibrations of the side wall 7.

Furthermore two third embossings 11 are to be seen, which have the "banana shape" mentioned in the description above. All embossings are curved inwards and this curvature is by around four times the thickness of the metal.

Figure 2:
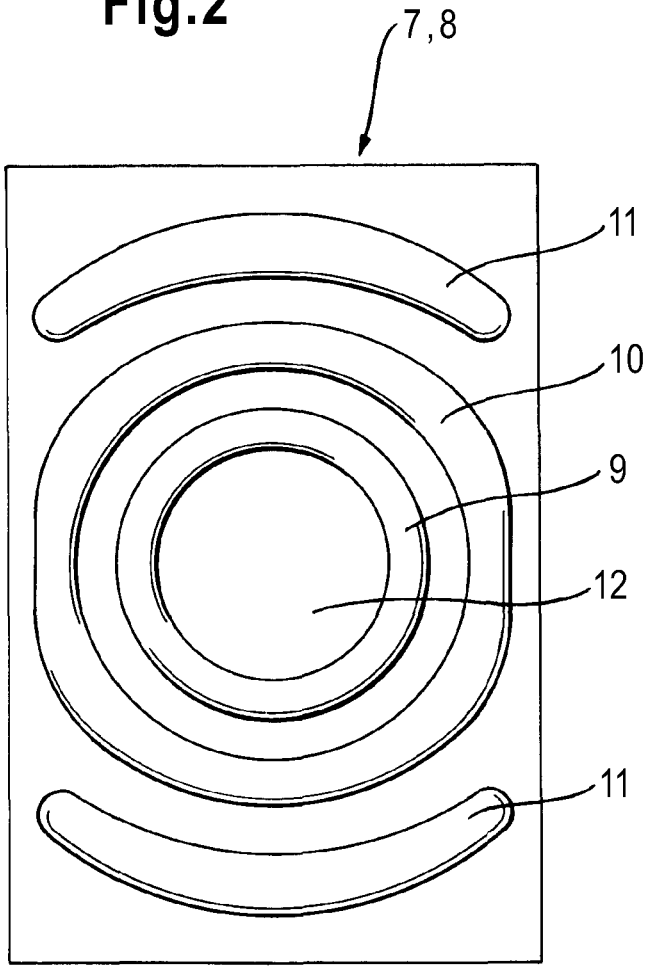
FIG. 2 a view from above of a first embossed side wall for a household appliance.
Figure 8:
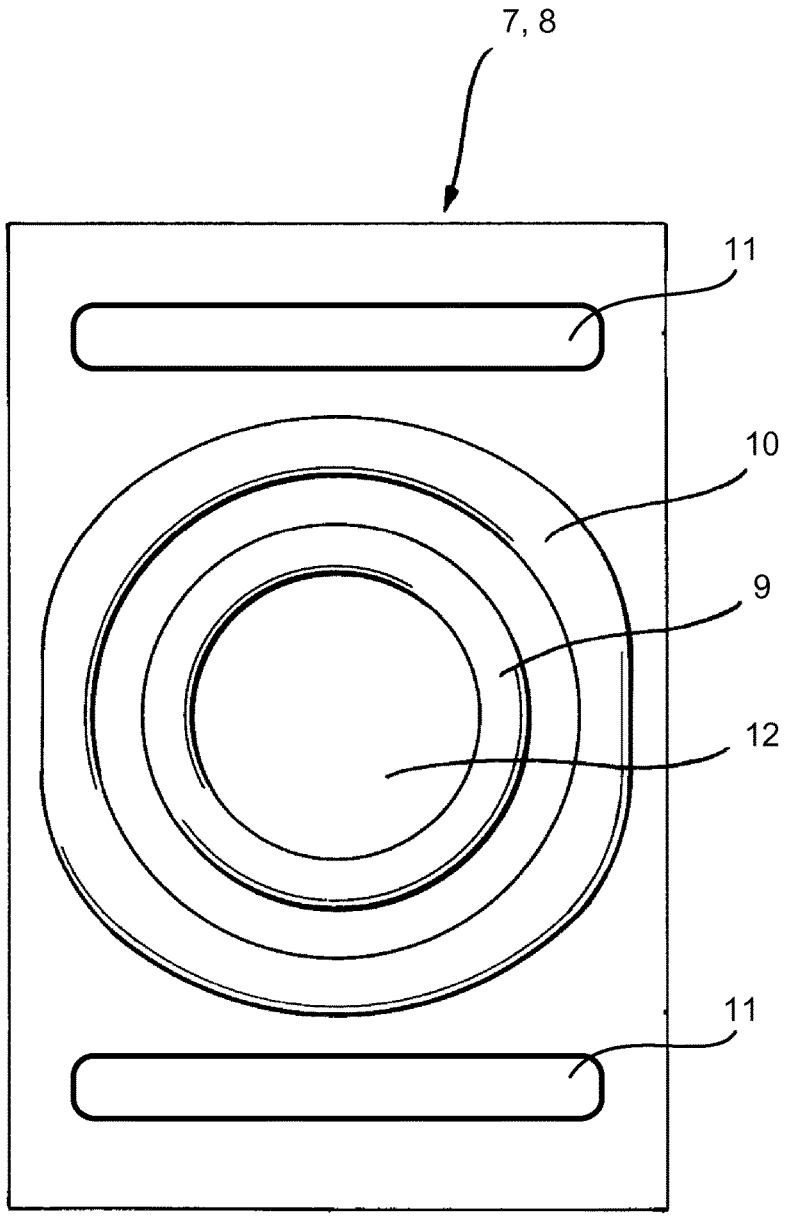
FIG. 8 a view from above of a sixth embossed side wall for a household appliance.

FIG. 2 shows the side wall 7, 8 shown in a perspective view in FIG. 1 once more in a view from above. The reference numbers are the same as in FIG. 1, since the side wall 7, 8 shown in the figure is the same as that shown in FIG. 1. However the shapes of the respective embossings 9, 10, 11 are better able to be seen in the view from above. FIG. 8 shows the side wall 7, 8 where third embossings 11 are straight.

Figure 3:
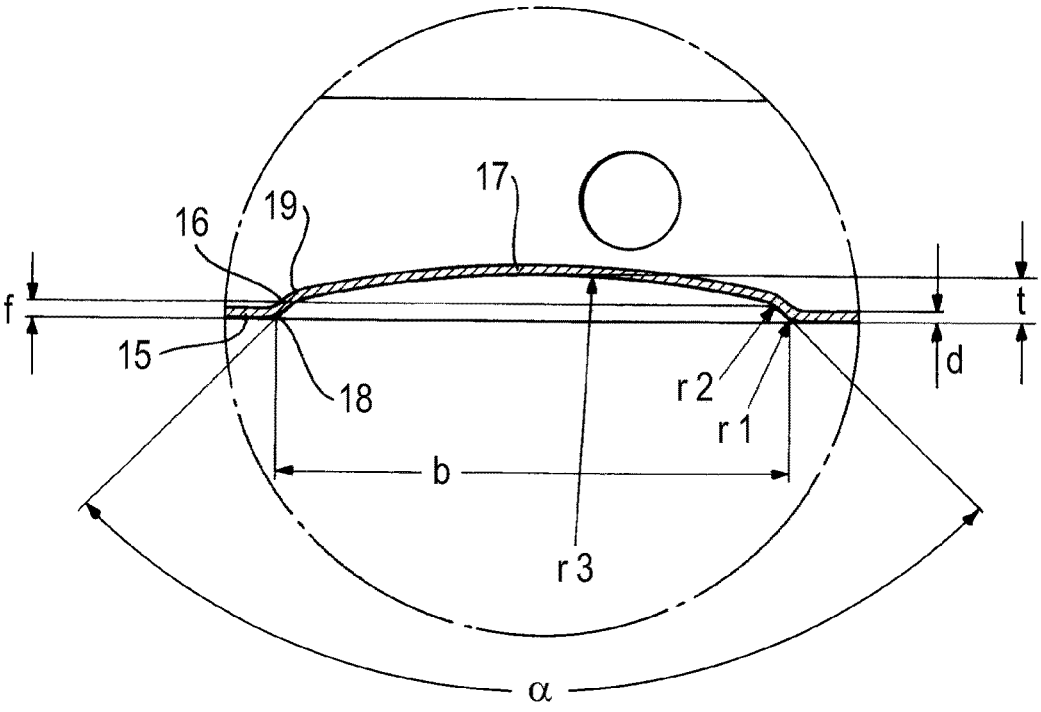
FIG. 3 a cross-section through an embossing.

FIG. 3 shows the cross-section through the central point or the center of the side wall 7, 8 depicted in FIG. 2. The section shown shows a cross-section through the ring of the first embossing 9. Since this first embossing 9 is the same thickness at every point there is no need to specify the point at which the section is cut. The section is embodied in the direction from the center along a radius of the ellipse of the first embossing 9. The metal side wall 15 with thickness d can thus be seen, which has a first embossing 9 which is curved inwards. The overall depth t of the first embossing 9 amounts to approximately four times the thickness d of the metal plate 15. The metal panel 15 is 0.88 mm thick in this case, and the depth t of the embossing 9 amounts to around 3.5 millimeters.

In this cross-section the shape of the curvature 17 with a bevel 16 can also be clearly seen. This shape is formed by two bending points 18 (from the outer edge of the first embossing 9) and 19 (between bevel and curvature). At the bending point 18 the metal sheet is bent into an angle, with this angle amounting to around 45° (in relation to the plane of the side wall). The angle between the two opposing sides of the bevel amounts to approximately 90° and is labelled $\alpha$. The bevel 16 has a straight surface. The respective bending points 18 and 19 are however embodied with radii r1 and r2 in order to avoid sharp-edged kinks. In this example radius r1 amounts to 2.5 cm and radius r2 to 1.5 cm. The bevel 16 of the curvature 17 is only very narrow, in this case its depth f amounts to around 1.3 mm. It has been shown that the use of such a bevel 16 is not only of advantage in the manufacturing of the first embossings 9. Such bevels 16 are therefore not only used for the first embossings 9 but for all first, second and third embossings 9, 10, 11 which are shown and described in this document.

The curvature 17 of the first embossing 9 has a very large radius r3, which can vary depending on the width and overall depth of the first embossing 9 selected. This radius r3 can be computed if one assumes that the curvature 17 involves a circle segment. However this does not absolutely have to be the case, instead the curvature 17 can also be produced by segments of ellipses or other ovals; this depends on the respective tool and thus on the desired type of curvature 17.

The width of the first embossing 9, which is to be seen in cross-section here, is measured between the corresponding bend points 18 on the inner side of the first embossing 9 and is labelled b. In this case the width b of the first embossing 9 amounts to around 4 cm. These dimensions have been selected in relation to the standard dimension of a side wall 7, 8 for a conventional washing machine 1.

FIGS. 4 through 7 show further exemplary embodiments of a side wall 7, 8 with first 9, second 10 and third embossings 11 as well as the central unembossed surface 12. Examples of the side wall 7, 8 in accordance with FIG. 4 have been manufactured for comparison with a conventional commercially-used side wall for a type of washing machine, which with the same material, instead of the embossings 9, 10 and 11 of the side wall 7, 8 in accordance with FIG. 4, has six straight strip-shaped embossings in parallel to its long side. Both side walls consisted of conventionally rolled sheet steel coated with plastic with a thickness of 0.88 mm in accordance with DIN EN 10142 DX53D+Z, 797 mm long, 529 mm wide and in each case edge sections aligned at right angles to the side wall of 20 mm or 23.5 mm depth. Compared to the conventional side wall, for the example of the side wall 7, 8 in accordance with FIG. 4 a stiffness increased by around 100% (approx. 40 N/mm2 instead of approx. 20 N/mm2) was determined and in addition a minimum inherent frequency increased by around 50%. These inherent frequencies of the examples of the side wall 7, 8 in accordance with FIG. 4 have been produced between 35 Hz and 40 Hz and thus lie far above a conventionally realized maximum rotational frequency of a washing drum in a washing machine during spinning, which rotational frequency of 1600 rpm amounts to approximately 26.7 Hz. Thus with a washing machine which is equipped with this type of side wall 7, 8 even during the greatest stress during spinning of washing there is not likely to be an excitation of the side wall 7, 8 at a resonant frequency. An especially silent running of the washing machine can thus be achieved in this way.

Figure 4:
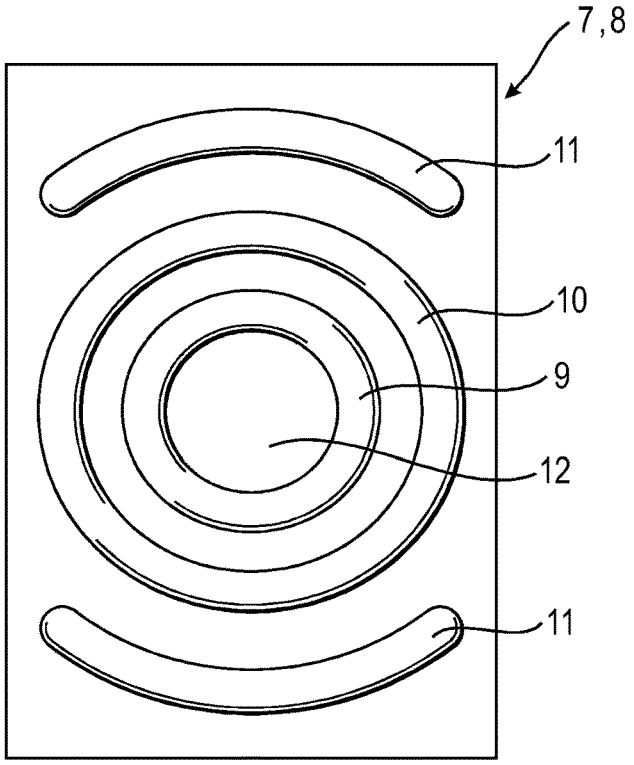
FIG. 4 a view from above of a second embossed side wall for a household appliance.
Figure 5:
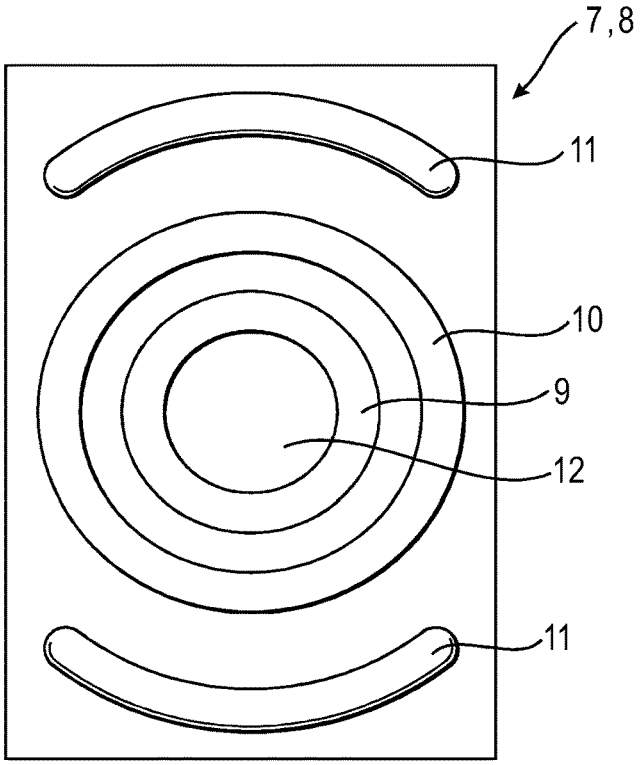
FIG. 5 a view from above of a third embossed side wall for a household appliance.

With the side wall 7, 8 in accordance with FIG. 5 it should be noted that its embossings 9, 10 and 11 are designed flatter than the embossings of the side wall 7, 8 in accordance with FIG. 4. The side wall 7, 8 in accordance with FIG. 5 is therefore primarily not intended for a washing machine but for a tumble dryer, which is characterized by a far lower vibration stress during operation by comparison with a washing machine.

Figure 6:
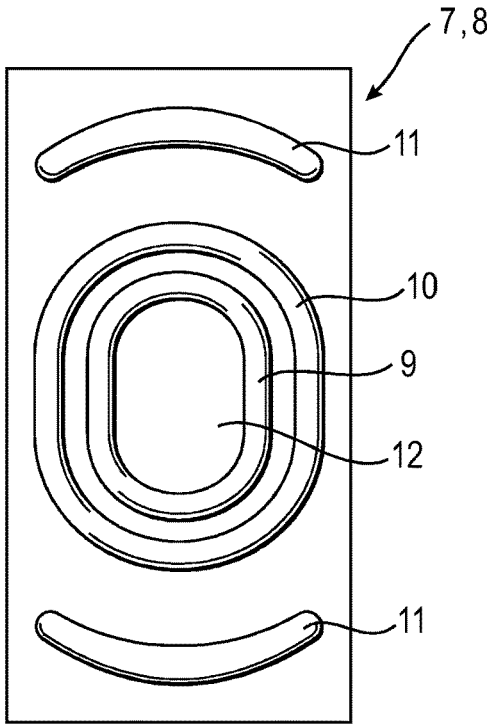
FIG. 6 a view from above of a fourth embossed side wall for a household appliance.
Figure 7:
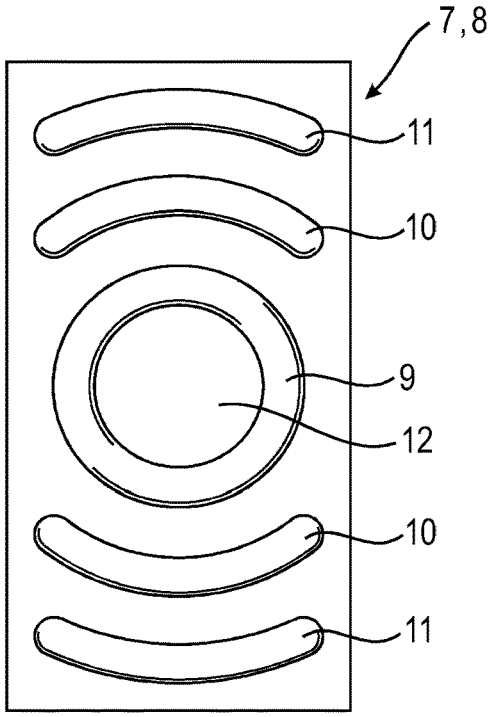
FIG. 7 a view from above of a fifth embossed side wall for a household appliance.

The side walls 7, 8 in accordance with FIGS. 6 and 7 are far narrower than those in accordance with FIGS. 2, 4 and 5, and are thus intended for washing machines and tumble dryers with smaller depth dimensions for use in confined spaces. With such a side wall 7, 8 in accordance with FIG. 6 the first and second embossings 9 and 10 can be embodied clearly oval. As shown in FIG. 7, it is also conceivable especially with such a side wall, instead of a ring-shaped second embossing 10 as in all other corresponding figures, to provide a second embossing 10 in the shape of two arcs 10, corresponding more closely to the third embossing 11 than the first embossing 9.

In any event the teaching of the invention contained herein makes possible a household appliance with a side wall which, by comparison with conventional side walls, is characterized by far superior properties in respect of its rigidity and resonant frequencies and in addition also provides a useful expansion of the wealth of forms for aesthetically motivated designs.

LIST OF REFERENCE CHARACTERS

1 Household appliance, washing machine
2 Housing
3 Front wall
4 Rear wall
5 Upper side
6 Lower side
7 Side wall
8 Side wall
9 First embossing
10 Second embossing
11 Third embossing
12 Unembossed surface within the first embossing
13 Control panel
14 Door
15 Side wall panel
16 Bevel
17 Curvature
18 First bending point
19 Second bending point
d Metal thickness
b Width of the embossing (measured internally)
t Overall depth of the embossing (measured internally)
f Depth of the bevel (measured internally)
r1 Radius 1 of the first bending point
r2 Radius 2 of the second bending point
r3 Radius of the curvature
α Angle between two respective opposing walls of the bevel

The invention claimed is:

1. A household appliance, comprising:

a cabinet-shaped housing comprised of a plurality of walls, at least one of the walls having an arrangement of embossings, said arrangement of embossings comprising:

a first embossing arranged centered in relation to a center of said at least one wall and configured in the shape of a ring when viewed from above, a second embossing arranged outside the first embossing in substantial concentric relationship to the first embossing, said second embossing configured in the shape of a ring when viewed from above, and at least one third embossing configured in the shape of a strip and arranged outside the second embossing, wherein, as seen in cross section, the first, second and third embossings are formed by inwardly depressed curvatures, and each inwardly depressed curvature extends from a beveled edge, wherein a maximum depth of each of the first, second and third embossings is defined by a depth of the respective beveled edge in addition to a depth of the respective inwardly depressed curvature.

2. The household appliance of claim 1, wherein said at least one wall has two of said third embossing.

3. The household appliance of claim 2, wherein the two third embossings are arranged point-symmetrically in relation to the center.

4. The household appliance of claim 2, wherein one of the two third embossings is arranged above the second embossing and the other one of the two third embossings is arranged below the second embossing.

5. The household appliance of claim 1, wherein two of the walls of the housing define rectangular side walls, at least one of the side walls including the arrangement of embossings.

6. The household appliance of claim 1, wherein the first embossing, when viewed from above, is delimited by two ovals concentric and similar to one another to thereby establish a ring-shaped element with a constant width.

7. The household appliance of claim 1, wherein the second embossing, when viewed from above, is delimited by two concentric and non-similar ovals to thereby establish a ring-shaped element with varying width.

8. The household appliance of claim 1, wherein the third embossing, when viewed from above, has a substantially straight configuration.

9. The household appliance of claim 1, wherein the third embossing is arranged in substantial concentric relationship to the second embossing and has the shape of a ring segment when viewed from above.

10. The household appliance of claim 1, wherein the third embossing, when viewed from above, is formed from two parallel arcs having ends which are connected to one another to thereby establish an arc-shaped element.

11. The household appliance of claim 1, wherein the third embossing, when viewed from above, is formed from a segment of two intersecting, non-similar ovals to thereby establish an arc-shaped element which is wider in midsection than at ends thereof.

12. The household appliance of claim 1, wherein the first, second and third embossings, when viewed from above, occupy around 40% of a surface of said at least one wall.

13. The household appliance of claim 1, wherein said at least one wall has a non-embossed surface encircled by the first embossing and defined by a diameter which corresponds to approximately one third of a width of said at least one wall.

14. The household appliance of claim 1, wherein each of the first, second and third embossings has a maximum depth which amounts to around three times to four times a thickness of said at least one wall.

15. The household appliance of claim 1, wherein the first embossing is delimited by two concentric circles, and the second embossing is delimited by an inner circle and an outer shape, the outer shape being formed from a circle that is truncated by two parallel straight sections.

16. The household appliance of claim 15, wherein the two parallel straight sections are parallel to edges of the at least one wall.

17. The household appliance of claim 16, wherein the third embossing, when viewed from above, is formed from two parallel arcs having ends which are connected to one another to thereby establish an arc-shaped element.

18. The household appliance of claim 15, wherein the third embossing, when viewed from above, is formed from two parallel arcs having ends which are connected to one another to thereby establish an arc-shaped element.

19. The household appliance of claim 1, wherein each said beveled edge is inwardly angled relative to an exterior of the at least one wall, and each said inwardly depressed curvature has a radius of curvature extending from and between the respective beveled edges.

20. The household appliance of claim 1, wherein the inwardly depressed curvature of the second embossing has a variable width.

21. The household appliance of claim 20, wherein the width is greater towards corners of the wall.

22. The household appliance of claim 1, wherein the third embossing has end portions and a middle portion, wherein a width of the middle portion of the inwardly depressed curvature of the third embossing is greater than a width of the end portions.

23. The household appliance of claim 1, wherein each beveled edge extends from a first bending point having a radius of curvature, the first bending point transitioning from an exterior surface of the wall to the respective beveled edge.

24. The household appliance of claim 23, further comprising a second bending point between each beveled edge and its respective inwardly depressed curvature, the second bending point having a second radius of curvature.

25. The household appliance of claim 24, wherein the first and second radius of curvature are different than one another.

26. The household appliance of claim 25, wherein the first radius of curvature is greater than the second radius of curvature.

27. The household appliance of claim 1, wherein the depth of each said inwardly depressed curvatures is greater than the depth of the beveled edge.

28. The household appliance of claim 1, wherein the depth of each said inwardly depressed curvatures is at least two times greater than the depth of the beveled edge.

29. The household appliance of claim 1, wherein the depth of each said inwardly depressed curvatures is about five times greater than the depth of the beveled edge.

30. The household appliance of claim 1, wherein the beveled edges of the first, second and third embossings are identical.

31. The household appliance of claim 1, wherein each beveled edge of the first, second and third embossings extends at a bevel angle with respect to an unembossed surface, and each of said inwardly depressed curvatures extends at a curvature angle with respect to the unembossed surface, and wherein the bevel angle of the first, second and third embossings is greater than the angle of each of said inwardly depressed curvatures.

* * * * *